US006715558B2

(12) United States Patent
Williamson

(10) Patent No.: US 6,715,558 B2
(45) Date of Patent: Apr. 6, 2004

(54) INFINITELY VARIABLE CONTROL VALVE APPARATUS AND METHOD

(75) Inventor: Jimmie Robert Williamson, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/083,048

(22) Filed: Feb. 25, 2002

(65) Prior Publication Data

US 2003/0159832 A1 Aug. 28, 2003

(51) Int. Cl.[7] ..... E21B 34/10; E21B 34/16

(52) U.S. Cl. ..... 166/375; 166/374; 166/386; 166/320

(58) Field of Search ..... 166/375, 374, 166/386, 320, 321

(56) References Cited

U.S. PATENT DOCUMENTS

| | | | | |
|---|---|---|---|---|
| 4,047,695 A | | 9/1973 | Cleveland et al. | |
| 4,066,128 A | * | 1/1978 | Davis et al. | 166/373 |
| 4,441,558 A | * | 4/1984 | Welch et al. | 166/317 |
| 4,569,398 A | * | 2/1986 | Pringle | 166/321 |
| 4,605,074 A | * | 8/1986 | Barfield | 175/4.52 |
| 4,697,998 A | * | 10/1987 | Zumbusch | 418/61.3 |
| 4,723,475 A | * | 2/1988 | Burk | 91/434 |
| 5,156,210 A | * | 10/1992 | Roth | 166/319 |
| 5,176,220 A | | 1/1993 | Akkerman | |
| 5,211,241 A | | 5/1993 | Mashaw, Jr. et al. | |
| 5,316,084 A | | 5/1994 | Murray et al. | |
| 5,431,188 A | | 7/1995 | Cove | |
| 5,794,699 A | | 8/1998 | Hammett et al. | |
| 5,957,207 A | | 9/1999 | Schnatzmeyer | |
| 5,979,558 A | | 11/1999 | Bouldin et al. | |
| 6,000,468 A | * | 12/1999 | Pringle | 166/53 |
| 6,024,183 A | * | 2/2000 | Dietz et al. | 180/9.1 |
| 6,082,458 A | | 7/2000 | Schnatzmeyer | |
| 6,098,714 A | * | 8/2000 | Deaton | 166/321 |
| 6,158,714 A | * | 12/2000 | Lembcke et al. | 251/122 |
| 6,213,202 B1 | * | 4/2001 | Read, Jr. | 166/55.1 |
| 6,276,458 B1 | | 8/2001 | Malone et al. | |
| 6,308,783 B2 | * | 10/2001 | Pringle et al. | 166/320 |
| 6,321,842 B1 | * | 11/2001 | Pringle et al. | 166/313 |
| 6,338,385 B1 | | 1/2002 | Muchow | |
| 6,349,770 B1 | * | 2/2002 | Brooks et al. | 166/383 |
| 6,422,317 B1 | * | 7/2002 | Williamson, Jr. | 166/374 |
| 2002/0020534 A1 | | 2/2002 | Wilson et al. | |

FOREIGN PATENT DOCUMENTS

| | | |
|---|---|---|
| GB | 2262954 A | 7/1993 |
| WO | WO 00/79094 A1 | 12/2000 |

* cited by examiner

*Primary Examiner*—David Bagnell
*Assistant Examiner*—T. Shane Bomar
(74) *Attorney, Agent, or Firm*—Peter V. Schroeder

(57) ABSTRACT

In carrying out the principles of the present invention, in accordance with an embodiment thereof, an annular choke apparatus, and methods of use, are provided for use within a subterranean well. In broad terms, a choke tool apparatus is provided which includes an outer housing having an outer housing wall with at least one flow port therethrough, and a variable annular flow-area choke disposed within the outer housing, the variable annular flow-area choke having a first generally tubular member sealingly disposed within the outer housing, the first tubular member having a shoulder with a sealing surface, a second generally tubular member slidingly and sealingly disposed within the outer housing, the second tubular member having a shoulder with a sealing surface, the second member movable between a sealed position wherein the sealing surfaces are in sealing abutment and an open position wherein the sealing surfaces are spaced apart. The sealing surfaces preferably provide a metal-to-metal seal. The variable annular flow-area choke described herein preferably provides for infinite adjustment between open and closed positions for precise flow regulation. The apparatus may include an actuator, locking, adjustment and biasing assemblies.

60 Claims, 9 Drawing Sheets

INFINITELY VARIABLE CONTROL VALVE APPARATUS AND METHOD

TECHNICAL FIELD

The present invention relates generally to apparatus utilized to control fluid flow in a subterranean well and, more particularly provides a choke for selectively regulating fluid flow into or out of a tubing string disposed within a well.

BACKGROUND

Typically, a flow control apparatus is used to throttle or choke fluid flow into a production tubing string of a subterranean hydrocarbon well. Such flow control chokes are particularly useful where multiple zones are produced and it is desired to regulate the rate of fluid flow into the tubing string from each zone. Additionally, regulatory authorities may require that rates of production from each zone be reported, necessitating the use of a choke apparatus or other methods of determining and/or controlling the rate of production from each zone. Safety concerns may also dictate controlling the rate of production from each zone.

Flow chokes are also useful in single zone completions. For example, in a single wellbore producing from a single zone, an operator may determine that it is desirable to reduce the flow rate from the zone into the wellbore to limit damage to the well, reduce water coning and/or enhance ultimate recovery.

Downhole valves, such as sliding side doors, are designed for operation in a fully closed or fully open configuration and, thus, are not useful for variably regulating fluid flow therethrough. Downhole chokes typically are provided with a fixed orifice which cannot be variable without intervention. These are placed downhole to limit flow from a certain formation. Unfortunately, conventional downhole valves and chokes are also limited in their usefulness because intervention is required to change the fixed orifice or to open or close the valve. Additionally, it is difficult to open a sliding side door slowly against a large differential pressure (such as, in excess of 2500 psi) without damage to any of the door seals because these seals must pass through the flow.

What is needed is a flow control apparatus which is rugged, reliable, and long-lived, so that it may be utilized in completions without requiring frequent service, repair or replacement. To compensate for changing conditions, the apparatus should be adjustable. The apparatus should be resistant to erosion, even when it is configured between its fully open and closed positions, and should be capable of accurately regulating fluid flow. Additionally, there is a need for a variable choke which can open against a high differential pressure without excessive damage to the choke seals.

Such a downhole variable choking device would allow an operator to maximize reservoir production into the wellbore. It would be useful for completions, including any well where it is desired to control fluid flow, such as gas wells, oil wells, and water and chemical injection wells, in sum, in any downhole environment for controlling the flow of fluids.

This is accordingly an object of the present invention to provide such a flow control apparatus which permits infinitely variable downhole flow choking as well as the ability to shut off fluid flow, and associated methods of controlling fluid flow within a subterranean well.

SUMMARY

In carrying out the principles of the present invention, in accordance with an embodiment thereof, an annular choke apparatus, and methods of use, are provided for use within a subterranean well. In broad terms, a choke tool apparatus is provided which includes an outer housing having an outer housing wall with a least one flow port therethrough, and a variable annular flow-area choke disposed within the outer housing, the variable annular flow-area choke having a first generally tubular member sealingly disposed within the outer housing, the first tubular member having a shoulder with a sealing surface, a second generally tubular member slidingly and sealingly disposed within the outer housing, the second tubular member having a shoulder with a sealing surface, the second member movable between a sealed position wherein the sealing surfaces are in sealing abutment and an open position wherein the sealing surfaces are spaced apart. The sealing surfaces preferably provide a metal-to-metal seal. The variable annular flow-area choke described herein preferably provides for infinite adjustment between open and closed positions for precise flow regulation. The apparatus may include an actuator, locking, adjustment and biasing assemblies. In gas lift and other operations it may be desirable to variably regulate the flow without sealing the valve.

These and other aspects, features, objects, and advantages of the present invention will be more fully appreciated following careful consideration of the detailed description and accompanying drawings set forth hereinbelow.

DETAILED DESCRIPTION

Figure 1A:
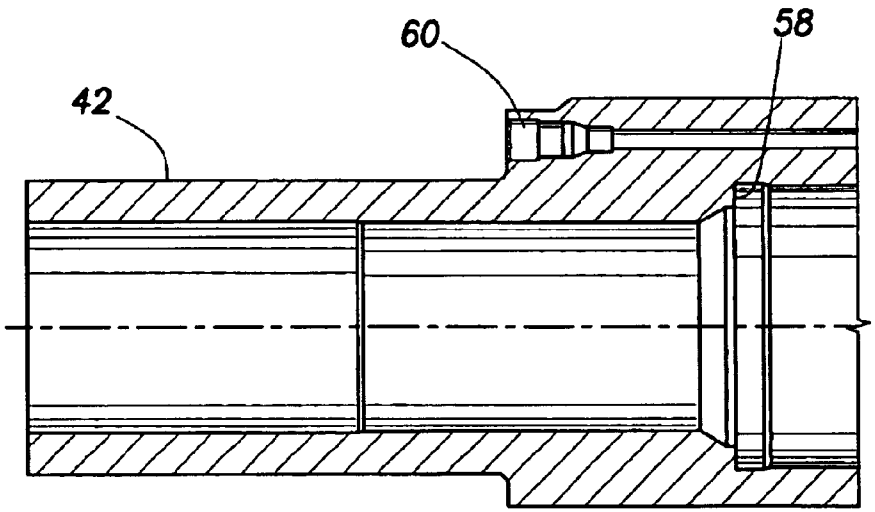
FIGS. 1A–C are sectional views taken along line A—A of FIG. 4, of successive longitudinal portions of a choke embodying principles of the present invention, the choke shown in a configuration for running into a subterranean wellbore.
Figure 1B:
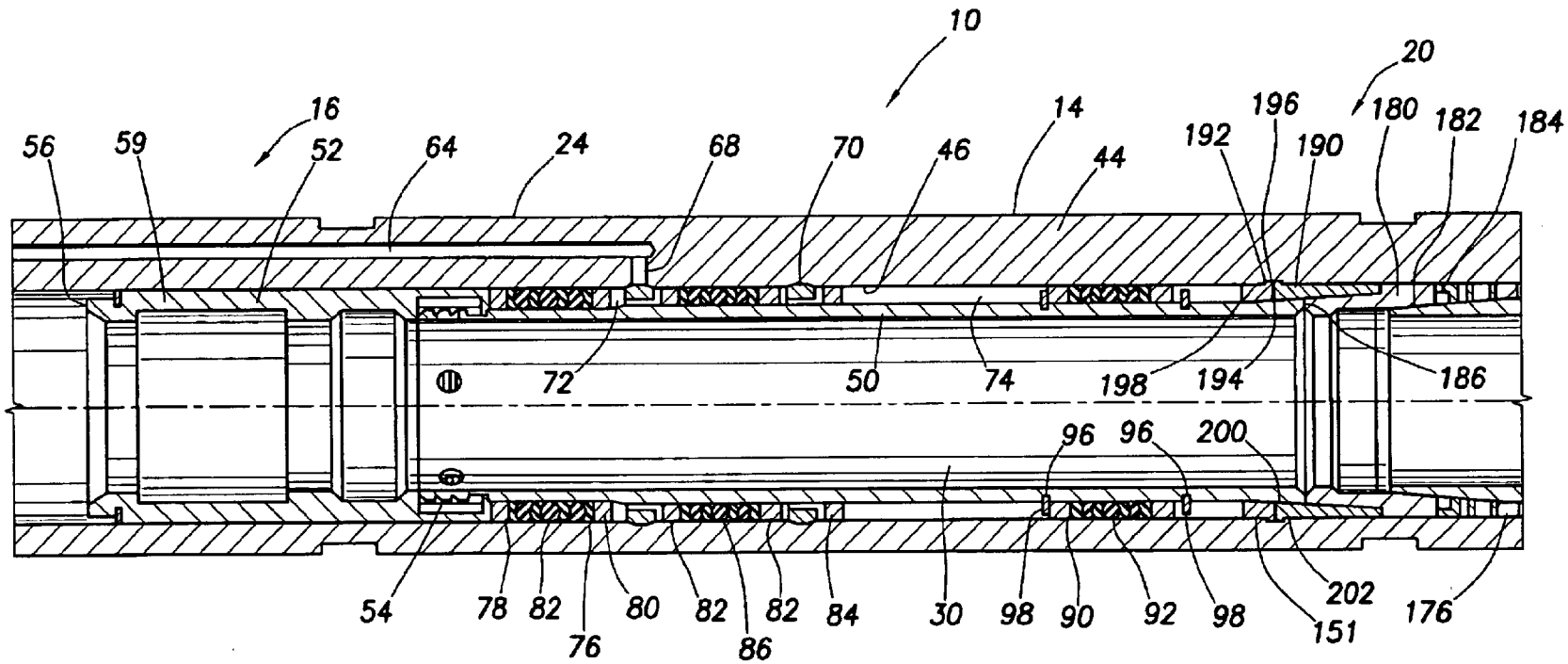
Figure 1C:
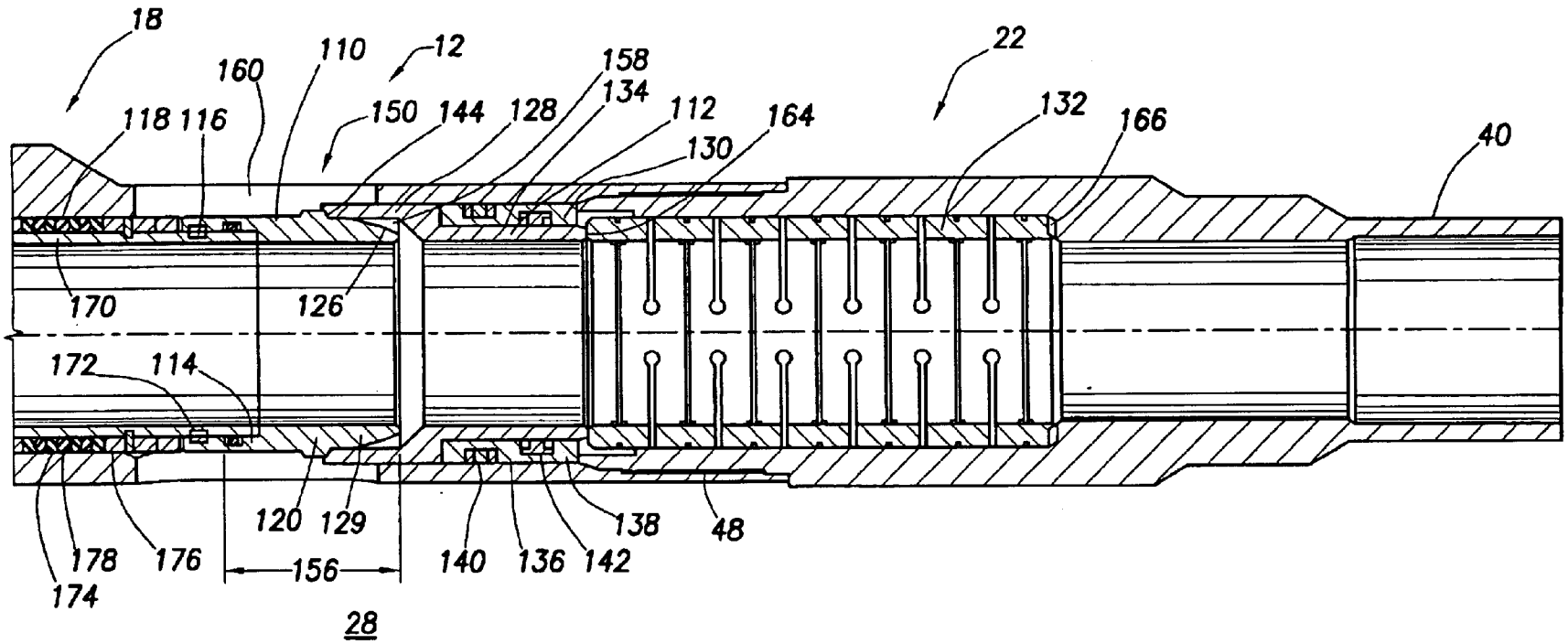

Illustrated in FIGS. 1A–C is a tool assembly 10 embodying the principles of the invention. In the following description of the tool assembly 10 and other apparatus and methods described herein, directional terms, such as "above", "below", "upper", "lower", etc., are used for convenience in referring to the accompanying drawings. Although the tool assembly 10 and other apparatus, etc., shown in the accompanying drawings are depicted in successive axial sections, it is to be understood that the sections form a continuous assembly. Additionally, it is to be understood that the various embodiments of the present invention described herein may be utilized in various orientations, such as inclined, inverted, horizontal, vertical, etc., without departing from the principles of the present invention.

The tool assembly 10, as shown, includes a choke assembly 12 disposed within a generally tubular outer housing 14. An actuator assembly 16, adjustment assembly 18, locking assembly 20, and biasing assembly 22 may also be included.

In a method of using the tool assembly 10, the variable annular flow-area choke assembly 12 and actuator assembly 16 are positioned within a subterranean well as part of a production tubing string 24 extending to the earth's surface. As representatively illustrated in FIGS. 3A–C, fluid (indicated by arrows 26) may flow axially through the tool assembly 10, and to the earth's surface via the tubing string 24. The fluid 26 may, for example, be produced from a zone of the well below the tool assembly 10. In that case, an additional portion of the tubing string 24 including a packer (not shown) would be attached in a conventional manner to a lower adaptor 40 of the tool assembly 10 and set in the well in order to isolate the zone below the tool from other zones of the well. The tool assembly 10 enables accurate regulation of fluid flow between the external area 28 and an internal axial fluid passage 30 extending through the choke.

In another method of using the tool assembly 10, multiple chokes may be installed in the tubing string 24, with each of the tools corresponding to a respective one of multiple zones intersected by the well, and with the zones being isolated from each other external to the tubing string. Thus, the tool assembly 10 also enables accurate regulation of a rate of fluid flow from each of the multiple zones, with the fluids being commingled in the tubing string 24.

It is to be understood that, although the tubing string 24 is representatively illustrated in the accompanying drawings with fluid 26 entering the lower adaptor 40 and flowing upwardly through the fluid passage 30, the lower connector 40 may actually be closed off or otherwise isolated from such fluid flow in a conventional manner, such as by attaching a bull plug thereto, or the fluid 26 may be flowed downwardly through the fluid passage 30, for example, in order to inject the fluid into a formation intersected by the well, without departing from the principles of the present invention.

The outer housing 14 preferably has a lower adapter 40 and upper adapter 42 for attaching the tool assembly 10 as part of a tubing string 24. The upper adapter 42 is integrally formed with outer housing 14 while the lower adapter 40 is sealingly attached at threads 48 to form part of the housing 14. It is understood that various portions of the tool assembly may be integrally formed with one another or attached together as is known in the art. As shown, the tool has only a single body joint thread enabling manufacture at a reduced cost compared to other designs. The generally tubular outer housing wall 44 separates an exterior area 28 from an internal fluid passageway 30. Wall 44 defines an interior surface 46. The Figures show the generally tubular fluid passage 30 offset from the center of the generally tubular outer housing 14. Such an arrangement better allows for placement of hydraulic inlets, fluid ports, control lines, and the like. It is understood that any of the generally tubular assemblies and parts described herein may be arranged concentrically or not, as desired, may be circular in cross-section, as shown, or may contain irregularities.

The variable annular flow-area choke assembly 12 is sealingly attached to the actuator assembly 16, shown in FIGS. 1A–C. The actuator assembly 16 is used to operate the variable choke 12. The actuator assembly shown is only an example of actuators known in the art and hydraulically controlled, but it is understood that the actuator may be hydraulically, electrically, mechanically, magnetically or otherwise controlled as is known in the art.

Figure 3A:
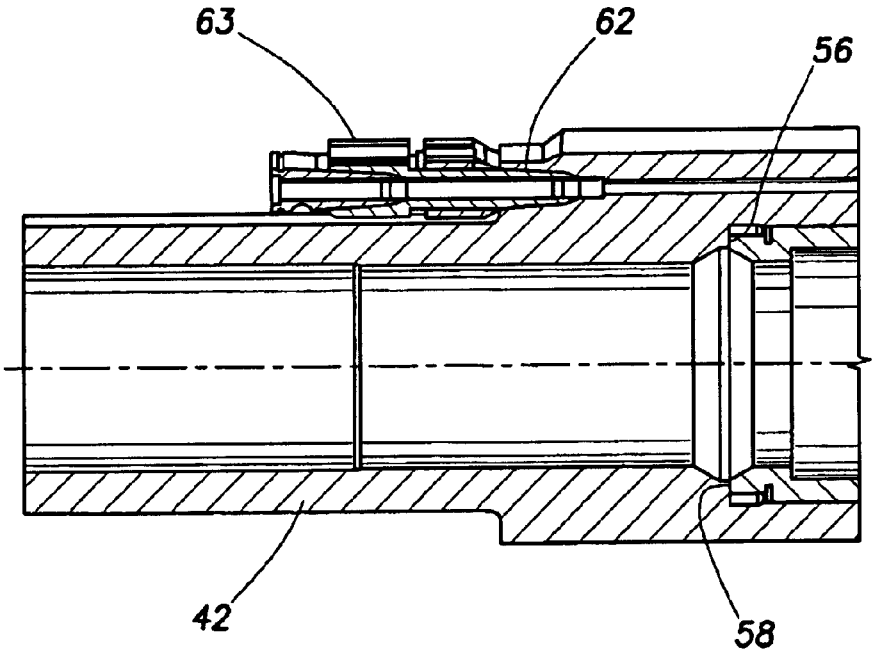
FIGS. 3A–C are sectional views taken along line B—B of FIG. 4, of the choke shown in a fully open position.
Figure 3B:
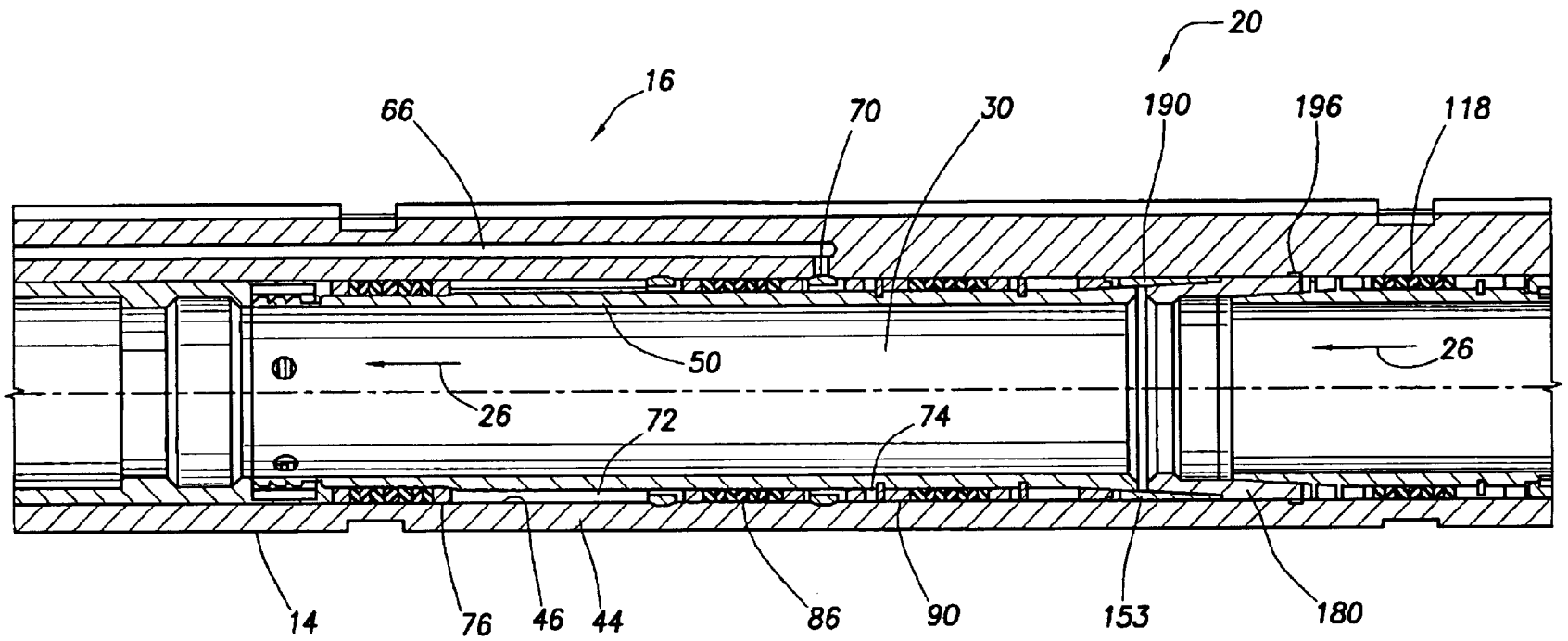
Figure 3C:
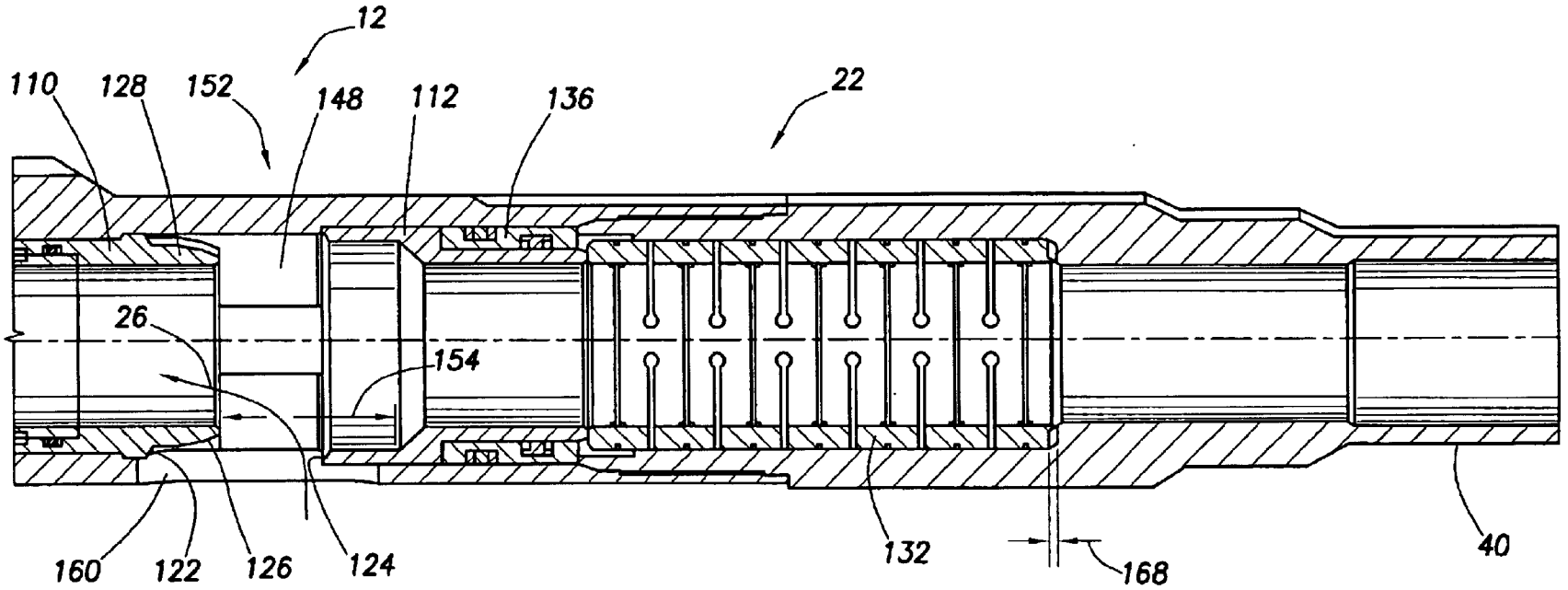

The actuator assembly 16 axially displaces mandrel 50 along the interior of outer housing 14. Preferably, mandrel 50 is connected to choke assembly 12 through locking assembly 20 and adjustment assembly 18, as shown, however, other arrangements can be employed as desired. Mandrel 50 includes profile sleeve 52 and is attached thereto by latch ring assembly 54. Mandrel 50 and sleeve 52 may be integrally formed, but for tool assembly purposes are preferably separate. Profile sleeve 52 moves axially along the interior wall surface 46 of the outer housing 14. Upward movement of sleeve 52 is limited, as seen in FIGS. 3A–C, by contact between mating shoulder surface 56 on the upper end 60 of mandrel 50 and corresponding shoulder 58 defined by the interior surface 46 of outer housing 14.

Figure 4:
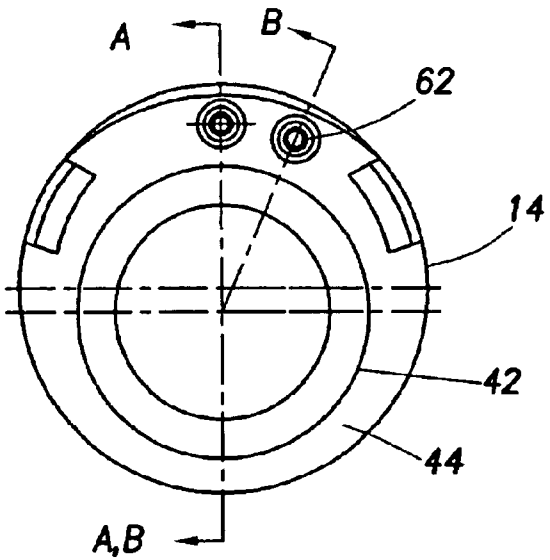
FIG. 4 is an end view of the upper end of the tool assembly.

Mandrel 50 is hydraulically reciprocally actuated. Hydraulic supply lines (not shown) supply hydraulic pressure at upper and lower hydraulic inlets 60 and 62, as seen in FIG. 4. Pressure is transmitted along upper and lower hydraulic passages 64 and 66 and upper and lower hydraulic ports 68 and 70, which are preferably defined within housing wall 44 as shown. Hydraulic inlet ports 60 and 62 may be attached to a hydraulic control line fitting 63 as seen in FIG. 3.

Upper hydraulic port 68 supplies hydraulic pressure to upper hydraulic chamber 72 in the annular space between mandrel 50 and outer housing wall 44. Upper piston 76 is attached externally about mandrel 50. Upper piston preferably includes bearing rings 78 and 80 and circumferential seals 82, preferably a vee-packing seal. Upper piston 76 is engaged with mandrel 50 such that axial movement of the piston 76 by the actuator assembly 16 causes a corresponding axial displacement of the mandrel 50. Movement of the piston 76 causes movement of the choke assembly 12 from a closed position 150, as seen in FIGS. 1A–C, towards an open position 152, as seen in FIGS. 3A–C. The variable annular flow-area choke 12 is preferably infinitely variable and is seen in an intermediate or partially open position in FIG. 2.

The mandrel 50 is sealingly received in the outer housing 14. Circumferential seal 86 sealingly engages the mandrel 50 externally and permits fluid isolation between the upper hydraulic chamber 72 and lower hydraulic chamber 74. Seal 86 is preferably a vee-packing seals and may include bearing rings 82 and 84.

Figure 2:
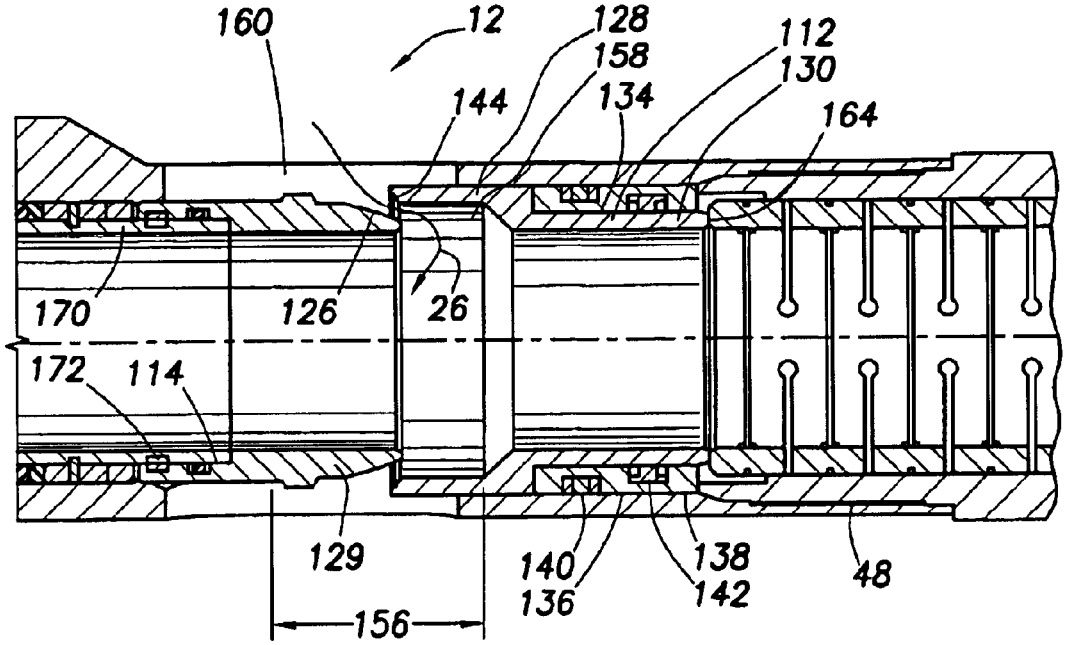
FIG. 2 is a sectional view of the choke shown in a partially open position.

Lower hydraulic port 62 supplies pressure to lower hydraulic chamber 74 in the annular space between mandrel 50 and wall 44 below seal 86 and is operable to axially move lower piston 90. Lower piston 90 preferably includes seal 92, and retaining rings 98 which cooperate with corresponding grooves 96 in mandrel 50. Axial displacement of lower piston 90 facilitates corresponding axial displacement of mandrel 50 and operates to move the choke assembly 12 from any open position, such as seen in FIGS. 2 and 3, towards a closed position 150, as in FIG. 1.

It is understood that selective operation of actuator assembly 16 operates to selectively open and close choke assembly 12. The choke 12 may be moved to an open position 152, as in FIG. 3, or a closed position 150, as in FIG. 1, or any position therebetween, making the choke infinitely variable.

Axial displacement of the mandrel 50 is accomplished by applying fluid pressure to one of the chambers 72 or 74, thereby applying an axially directed biasing force to the pistons 76 or 90, respectively. For example, if it is desired to displace the mandrel 50 axially upward to permit or increase fluid flow through the choke 12 or to decrease resistance to fluid flow therethrough, fluid pressure may be applied to the upper chamber 72. Conversely, if it is desired to downwardly displace the mandrel 50 to prevent or decrease fluid flow through the choke 12 or to increase resistance to fluid flow therethrough, fluid pressure may be applied to the lower chamber 74.

It is understood that the actuator assembly 16 may be of various types, mechanical, hydraulic or others. Alternate actuator assemblies and other tool parts may be found in U.S. Pat. No. 5,979,558 issued to Bouldin, which is hereby incorporated by reference for all purposes.

Choke assembly 12, shown in FIGS. 1A–C, includes upper choke member 110 and lower choke member 112. Choke members 110 and 112 are generally cylindrical and are circumferentially and sealingly disposed within outer housing 14.

Upper choke member 110 is slidably disposed in the outer housing 14 and is operably connected to the actuator assembly 16 for axial movement within the housing. Although it is preferable that the upper choke member be mounted for movement, it is understood that either or both of the choke members may be so mounted. The upper end 114 of the upper choke member 110 is sealingly attached to adjustment assembly 18 by retaining ring 116 and seal 118, preferably an o-ring seal. The mating end 120 of the upper choke member 110 has a preferably integrally-formed mating shoulder 122 formed thereon for abutment with a similar mating shoulder 124 on the lower choke member 112. Upper choke member 110 preferably includes annular projection 129 which extends, at least when the upper choke member 110 is in a closed position, as shown in FIGS. 1A–C, into the interior 158 within the choke end 128 of lower choke member 112. Projection 129 of upper choke member 110 preferably includes a flow regulating surface 126.

Figure 6:
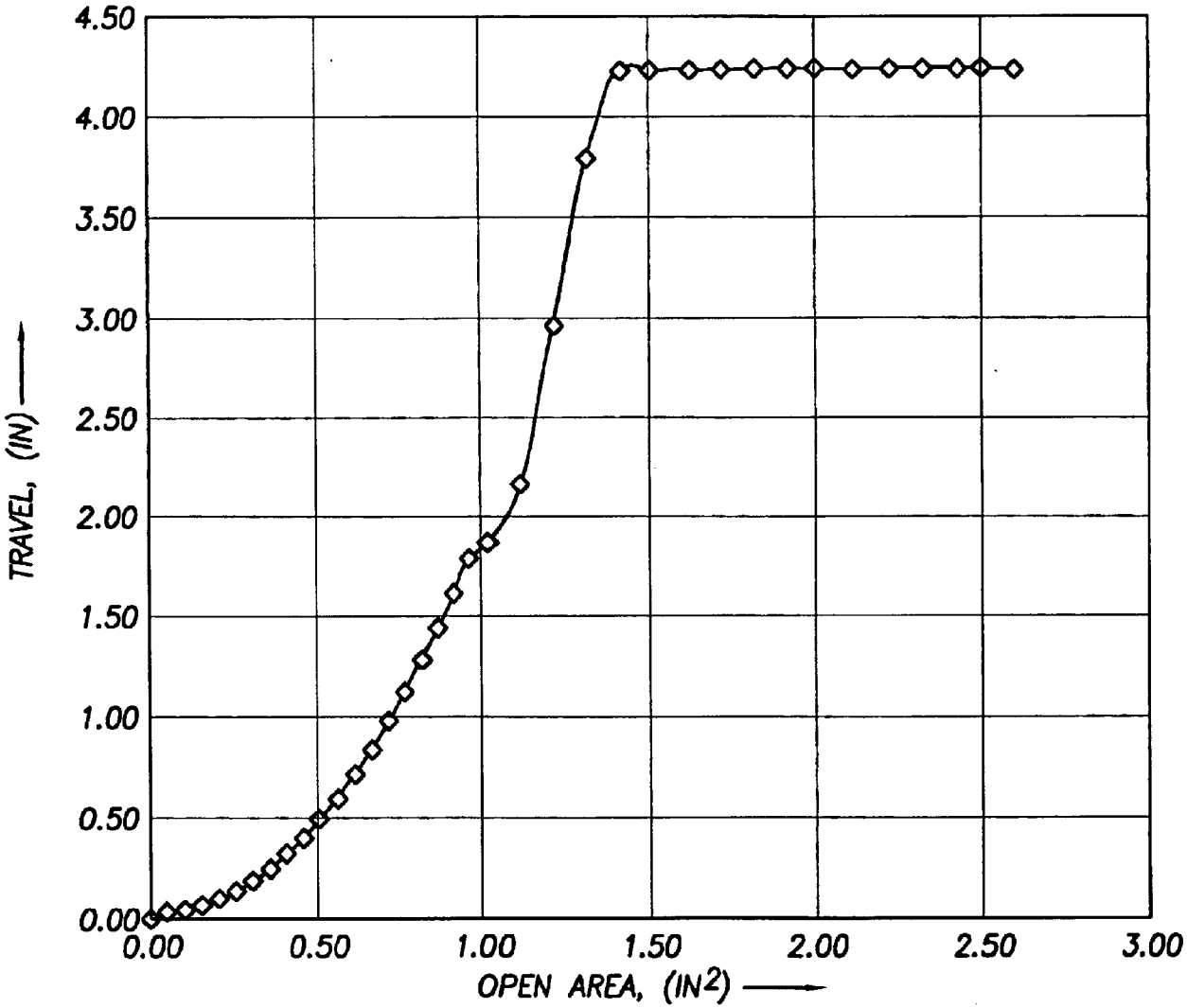
FIG. 6 is a graphical representation of the choke's open flow-area versus the travel of the choke members.

The outer surface 126 of projection 128 acts as flow regulator. The shape and features of the projection surface 126 determines the fluid flow rates through the variable annular flow-area port 148 as the choke members are opened or closed along path of travel 154. The projection surface 126 shape and features can be selected to regulate fluid flow as desired. For example, an arcuate surface, as shown in FIGS. 1–3, produces flow-area characteristics as shown in the graph of FIG. 6 which charts the increase in open flow-area, measured in square inches, versus the axial travel, in inches, of the upper choke number. The arcuate surface provides the desirable ability to open the choke area, and therefore reduce fluid pressure, slowly resulting in less damage to the formation than would occur with sudden pressure loss.

Figure 5A:
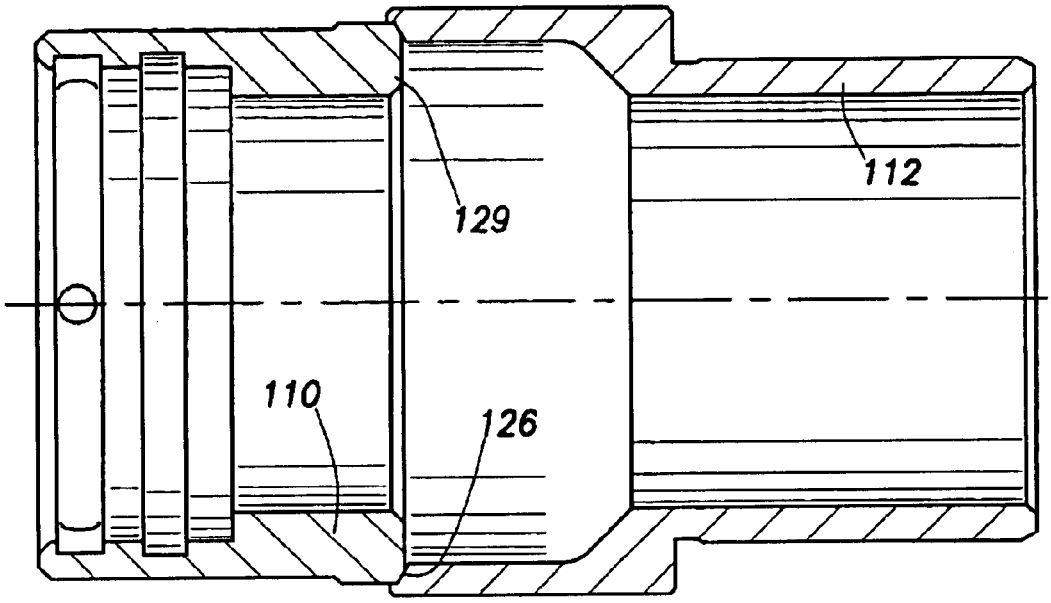
FIGS. 5A–D are detail views of various choke assemblies.
Figure 5B:
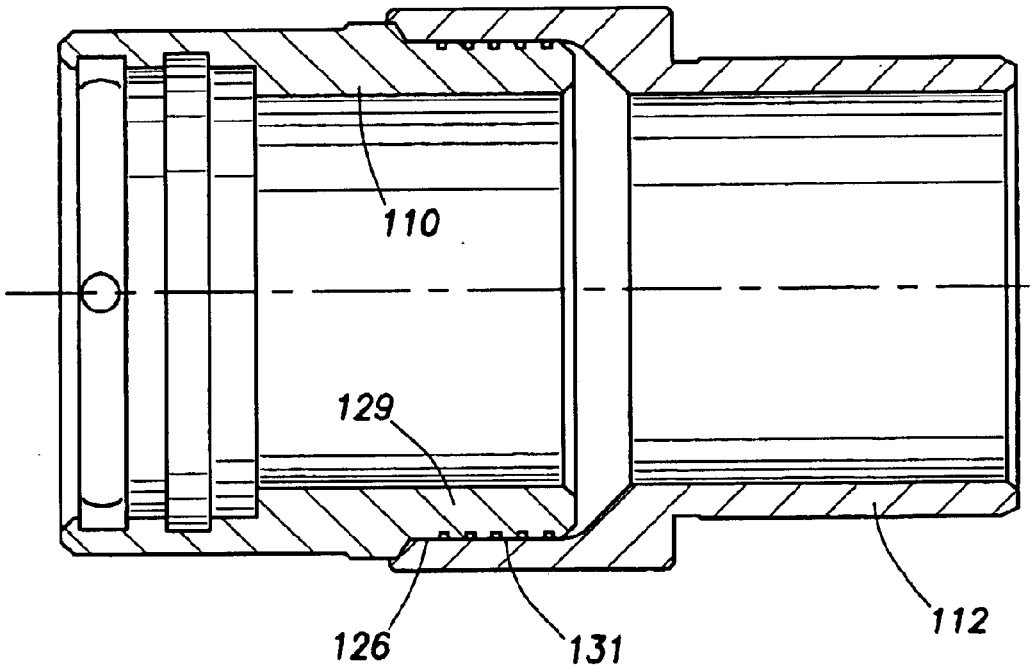
Figure 5C:
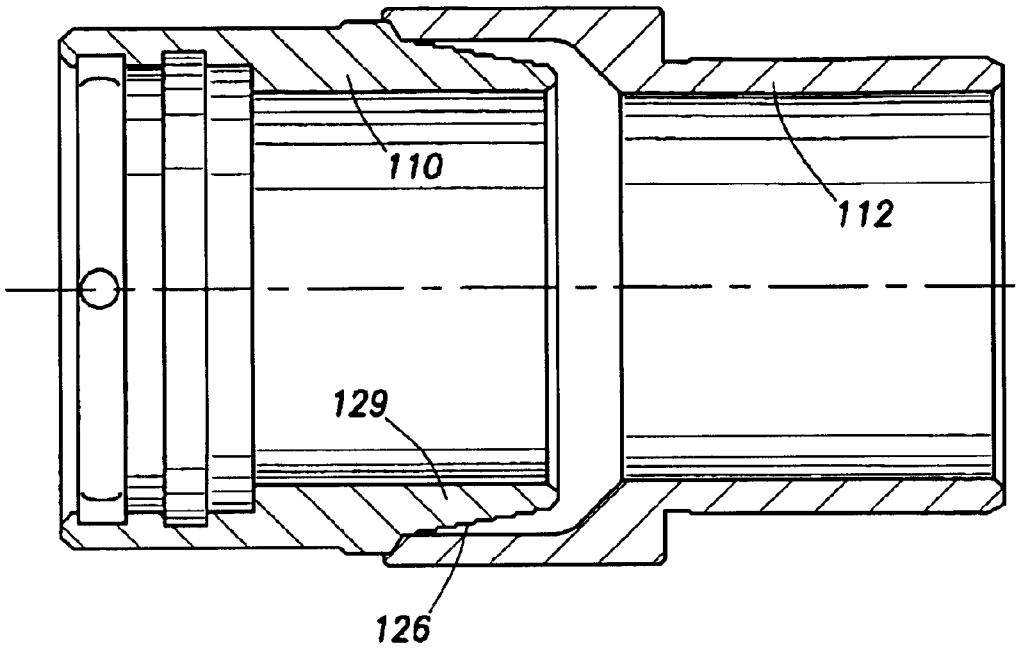
Figure 5D:
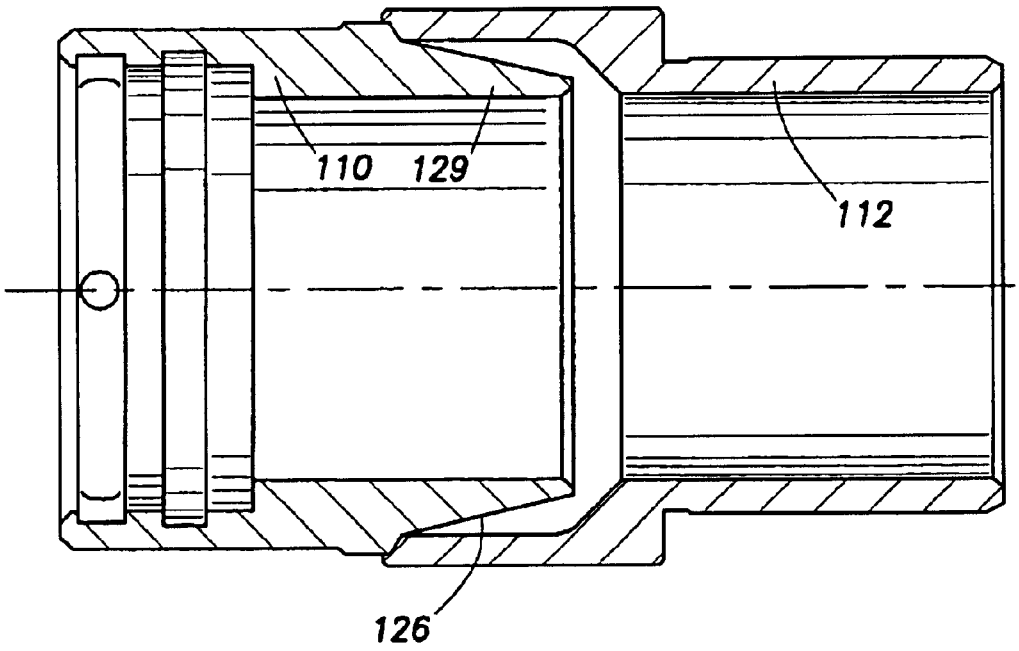

The flow regulating surface 126 can be of any desired shape and produce any desired flow-area to travel curve. Additionally, other features may be added to the projection surface to regulate fluid flow. Alternate projection shapes and features are shown in FIGS. 5A–D. FIG. 5A shows a blunt-nosed projection. FIG. 5B shows the addition of a labyrinth seal 131 to the projection surface 126. Labyrinth seals are known in the art to regulate fluid flow and various types of labyrinth seal can be employed on projection 129. FIG. 5C shows a stair-stepped projection surface 126 and FIG. 5D shows a conical surface 126. Other projection shapes and various combinations of the shapes and features may be used. For example, a labyrinth seal 131 can be used in conjunction with the stair-stepped projection surface.

The lower choke member 112 is preferably slidably and sealingly disposed within outer housing 14. The mating end 128 of the lower choke member 112 has a preferably integrally-formed mating shoulder 124 formed thereon for abutment with mating shoulder 122 of the upper choke member. Mating shoulder 124 abuts shoulder 125 of the housing wall 46 to prevent upward axial movement of the lower choke member 112 when the choke is open. The lower end 130 of lower choke member 112 abuts a biasing assembly 22, and specifically bias spring 132. Recess 134, integrally formed on lower choke member 112, forms an annular space for spool assembly 136. Spool assembly 136 sealingly engages housing 14 at piston seal 140 and rod seal 142. Alternately, lower choke member 112 may be stationary with respect to upper member 110, or may be integrally formed with or attached to housing 14.

Upper and lower choke members 110 and 112 abut at mating shoulders 122 and 124 forming an infinitely adjustable annular choke at annular seal 144. The annular seal is preferably of a hard, erosion-resistant material, such as ceramic or metal such as tungsten carbide, stellite or of alloy. Other seals, as are known in the art, may be used. The annular seal 144 may seal against liquid and/or gas pressure, as desired. A hard-surfaced seal, unlike rubber, plastic or other soft seals, is preferred.

The choke assembly 12, upper and lower choke members 110 and 112 and annular seal 144 are shown in a closed position 150 in FIGS. 1A–C. The choke assembly is movable between the closed position 150 and the open position 152, seen in FIG. 3. The choke assembly is infinitely variable, that is, the choke member may be positioned, as desired, anywhere between the opened and closed positions, as shown for example, in FIG. 2. The exemplary embodiment illustrated can be opened to any position along stroke-path 154 which extends a longitudinal distance 156. The size of annular flow port 148 is controlled by adjustment of the choke members relative to one another. The stroke-path distance 156 may vary, but preferably allows projection 128 to fully clear the interior space 158 of lower choke member 112, as seen in FIG. 3.

Fluid flow from external area 28 into fluid passage 30 of tool assembly 10 is controlled through the infinitely variable annular flow port 148. The variable choke may be opened slowly against a large differential pressure, up to the working pressure of the choke, without damage to the seals. Typical sliding-door chokes can only be opened against a differential pressure of about 1500 psi without damaging the seals.

In gas lift and other operations, it may be desirable to maintain the variable annular area valve in a partially open, or cracked-open, position to allow unloading of the well. That is, in such an application, it would be undesirable or unnecessary to seal annular seal 144 or completely close the valve. In such a case the upper member 110 may be maintained in a partially open position, such as seen in FIG. 2, by use of hydraulic pressure or a stop, lock or other movement limiting device employed such that member 110 is prevented from sealing annular seal 144. The shoulders 122 and 124 would not need to seal off flow through valve 144. In the partially open position the shoulders 122 and 124 are adjacent one another, thereby restricting, but not eliminating fluid flow. The variable annular flow-area valve can be moved towards and into the fully open position, seen in FIG. 3, to allow greater fluid flow.

Annular fluid port 148 is preferably adjacent outer housing fluid port 160, which may consist of multiple openings through housing wall 44. The housing ports 160 may be placed anywhere along the housing wall 44, as long as they are in fluid communication with annular port 148, and may vary in size, design and placement, as desired.

The tool preferably includes a biasing assembly 22, as shown. The bias spring 132 abuts lower choke member 112 at shoulder 164 and abuts the tool housing 14 at shoulder 166. The bias spring may be of any type known in the art, such as the cylinder spring, shown, or belleville, coil or other springs. The bias spring 132 exerts a seating load on lower choke member 112 such that the annular flow port 148 remains sealed when the actuator assembly exerts little pressure on upper choke member 110. Further, where the upper choke member 110 is not under any sealing load, such as when in a locked closed run-in position, bias spring 132 acts to seal the annular valve. The bias spring also takes up any tolerances in the choke assembly. The bias spring 132 may have a deflection 168 and bias force as desired, and operates to move lower choke member 112 longitudinally within the outer housing for up to the defection distance.

The upper choke member 110 may be operably connected to the actuator assembly 16 through an adjustment assembly 18 and a locking assembly 20. The seat attachment subassembly 170 of the adjustment assembly 18 attaches to upper choke member 110 preferably via a retaining ring assembly 172, as shown. Other means for attachment may be used as desired. The seat attachment subassembly 170 is a cylindrical mandrel slidably and sealingly engaged within the outer housing 14. A sealing assembly 174, which may include spacers 176 and a sealing element 178, seals the annular space between the exterior of the seat attachment subassembly 170 and the interior wall 46 of the housing 14. The sealing element 178 is preferably a vee-packing seal, as shown, but may be any suitable.

The adjustment assembly 18 further includes an adjustment mandrel 180 which is adjustably attached to the seat attachment subassembly 170, preferably via a threaded assembly 182, as shown. The overall length of the adjustment assembly 18 may be selected by adjusting the attachment of the adjustment mandrel 180 to the seat attachment subassembly 170. An adjustment locking mechanism 184 is provided, such as the setscrew shown, to allow the adjustment assembly length to be selectively set. Adjustment mandrel 180 abuts the actuator mandrel 50 at shoulder 186.

Locking assembly 20 includes a retainer ring 190 threadingly attached to adjustment mandrel 180. The retainer ring 190 acts with lock ring assembly 192, including lock ring 194 and corresponding recess 196, and expander ring 198 in a manner known in the art. The retainer ring 190 has an inset shoulder 200 that mates with mandrel shoulder 202.

In use, the choke tool assembly 10 is run-in to a subterranean well to the desired depth. The tool assembly is preferably part of a tool string which may include numerous choke tool assemblies as well as other downhole tools. The lower and upper adapters 40 and 42 are provided for attachment to a tool string.

The tool assembly preferably has a locked closed run-in position 151 as shown in FIG. 1. In the locked position 151, the locking assembly 20 holds the choke assembly 12 in the sealed closed position 150 during run-in operations without hydraulic pressure in the actuator assembly 16. The locking assembly 20 acts in unison with the biasing assembly to maintain the choke in the closed position. In the locked position, the retainer ring 190 and lock ring assembly 192 maintain the choke assembly 12 in the closed position. Lock ring 194 cooperates with recess 196 in the inner surface 46 of the outer housing wall 44 and the expander ring 198 to prevent mandrel 50 from upward movement.

The locking assembly 20 may be unlocked, as is known in the art, by hydraulically actuating or mechanically engaging the mandrel 50 or profile sleeve 60 and pulling upwards to unlock the lock ring assembly 192. Shoulder 202 on mandrel 50 mates with shoulder 200 on the retainer ring 190 such that an upward force on the mandrel 50 will force retainer ring 198 upward as well, thereby forcibly moving the lock ring 194 from the recess 196. The locking assembly 20 is then in an unlocked position 153, and the choke may be operated. The locking assembly may be locked closed without requiring hydraulic actuator pressure being maintained.

The actuator assembly 16 operates to control the choke assembly 12. To move the upper choke member 110 towards the open position 152, hydraulic pressure is applied to upper hydraulic chamber 72 of the actuator assembly 16. Hydraulic pressure is supplied to upper hydraulic inlet 60 via hydraulic lines (not shown) and then along upper hydraulic passage 64, through upper port 68 and into upper hydraulic chamber 72. The hydraulic pressure acts upon upper piston 76 thereby moving the mandrel 50 upwards. Mandrel 50, which is attached to the locking and adjustment assemblies, causes the upper choke member 110 to similarly move in an upward direction, toward the open choke position 152. Hydraulic pressure can be applied, as desired, to move the upper choke member 110 any desired distance along choke path 154 between the closed and open positions 150 and 152 up to the total stroke distance 156.

In the closed position 150, the upper choke member 110 is sealingly engaged with the lower choke member 112 at mating shoulders 122 and 124 at metal-to-metal seal 144. As the upper choke member 110 is moved upwardly, the biasing assembly 22 also moves the lower choke member 112 upwardly. The lower choke member 112 will continue to move upwardly for a portion of the deflection distance, as determined by the selection of the deflection device. Once the upper and lower choke members 110 and 112 have moved the deflection distance 168, continued upward movement by the upper choke member 110 will unseat the mating shoulders 122 and 124 thereby creating an annular flow port 148 defined by the spaced apart mating shoulders.

The annular flow port 148 allows fluid connection between the external area 28, via fluid port 160, and the fluid passage 30. Fluid flow through the annular port 148 is controlled by selective movement of the upper choke member 110 to regulate the flow area available.

Preferably, the choke end 120 of the upper choke member 110 includes projection 129 which extends into the interior space 158 of the lower choke member 112. The outer surface of the projection 129 defines a choke regulating surface 126. The choke regulating surface 126 may be of any desired shape and may have additional features as desired. The shape of the regulating surface 126, by defining the shape of the annular port 148, regulates the flow area into the flow passage 30. Preferably, the stroke distance 156 of the choke member 110 is greater than the length of projection 129 such that, at the full open position 152, the projection 129 does not extend into the interior 148 of the lower choke member 112.

The upper choke member 110 may be moved downwardly, or towards the closed position 150, using the actuator assembly 16. Hydraulic pressure is supplied via hydraulic lines (not shown) to lower hydraulic inlet 62, through lower hydraulic chamber 74. An increase in hydraulic pressure within chamber 74 forces lower hydraulic piston 90 downward, thereby moving the mandrel 50 and upper choke member 110 downwardly.

By regulating the hydraulic pressure supplied to upper and lower chamber 72 and 74, the upper choke member 110 may be moved, or held stationary, as desired to any location along path 154, that is, in the open or closed positions, 150 and 152, or anywhere inbetween. Consequently, the choke is infinitely variable and flow through the annular port 148 can be infinitely regulated. The spacing of the choke member 110 and 112 and the design of projection 128 determine the flow rate through the annular port 148.

Described herein, the choke assembly and methods of controlling fluid flow within the well using the choke assembly, which provided reliability, ruggedness, longevity, and do not require complex mechanisms. Of course, modifications, substitutions, additions, deletions, etc., may be made to the exemplary embodiment described herein, which changes would be obvious to one of ordinary skill in the art, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A choke tool apparatus for use in a subterranean well operable to control fluid flow between the exterior of the tool and an axial passage within the tool, the choke tool comprising:

an outer housing having an outer housing wall with at least one flow port therethrough; and a variable annular flow-area choke disposed within the outer housing, the variable annular flow-area choke having a first generally tubular member sealingly disposed within the outer housing, the first tubular member having a shoulder with a sealing surface, the first member having an end defining an interior space therein, a second generally tubular member sealingly disposed within the outer housing, the second member having a shoulder with a sealing surface, the second member having a substantially tubular projection extending into the interior space of the end of the first member, at least one of the first or second tubular members slidingly disposed in the housing movable between a sealed position wherein the sealing surfaces are in sealing abutment and an open position wherein the sealing surfaces are spaced apart.

2. An apparatus as in claim 1 wherein the sealing surfaces are metal.

3. An apparatus as in claim 1 wherein the sealing surfaces are ceramic.

4. An apparatus as in claim 1 wherein the member slidingly disposed in the housing is infinitely adjustable between the sealed and open positions.

5. An apparatus as in claim 1 wherein the first member is unitary with the outer housing.

6. An apparatus as in claim 1 wherein the first member is slidingly disposed in the outer housing.

7. An apparatus as in claim 1 wherein the projection outer surface is arcuate.

8. An apparatus as in claim 1 wherein the projection outer surface defines a flow regulating means.

9. An apparatus as in 8 wherein the flow regulating means comprises a conical surface.

10. An apparatus as in claim 8 wherein the flow regulating means comprises a stair-stepped surface.

11. An apparatus as in 8 wherein the flow regulating means comprises a labyrinthian seal.

12. An apparatus as in 11 wherein the flow regulating means comprises a stair-stepped surface.

13. An apparatus as in claim 8 wherein the flow regulating surface comprises an arcuate surface.

14. An apparatus as in claim 1, the projection having an end, and wherein the projection end and the end of the first member are axially spaced apart when the member slidingly disposed in the housing is in the open position.

15. An apparatus as in claim 1 further comprising a biasing assembly.

16. An apparatus as in claim 15 wherein the biasing assembly comprises a spring.

17. An apparatus as in claim 15 wherein the first member is movable toward and away from the sealed position, and wherein the biasing assembly biases the first member toward the sealed position.

18. An apparatus as in claim 1 wherein the first member is designed for use downhole from the second member.

19. An apparatus as in claim 1 wherein the projection comprises a labyrinthian seal.

20. An apparatus as in claim 1 further comprising an actuator assembly operable to move the slidingly disposed member between the sealed and the open position.

21. An apparatus as in claim 20 wherein the actuator assembly is hydraulically actuated.

22. An apparatus as in claim 1 further comprising a locking assembly for selectively maintaining the slidingly disposed member in the sealed position.

23. An apparatus as in claim 22 wherein the locking assembly comprises a locking ring mechanism.

24. An apparatus as in claim 1 wherein the axial passage is not concentric with the outer surface of the outer housing wall.

25. An apparatus as in claim 1 wherein at least one flow port in the outer housing is adjacent to the sealing surfaces when the slidingly disposed tubular member is in the sealed position.

26. An apparatus as in claim 1 further comprising an adjustment assembly for selectively varying the spatial relationship of the first and second members when in the open position.

27. An apparatus as in claim 26 wherein the adjustment assembly comprises an adjustment mandrel threadingly attached to the second member.

28. A fluid flow control apparatus for use in a subterranean well comprising:

a substantially tubular outer housing having at least one flow port therethrough; and a variable annular flow-area valve disposed therein, the variable annular flow-area valve includes a first generally tubular member sealingly disposed within the outer housing, the first tubular member having a shoulder with a sealing surface, the first member defining an interior space therein, a second generally tubular member slidingly and sealingly disposed within the outer housing, the second tubular member having a shoulder with a sealing surface, the second member movable between a sealed position wherein the sealing surfaces are in abutment and an open position wherein the sealing surfaces are spaced apart, the second member having a projection extending into the interior space of the first member when in the sealing position.

29. An apparatus as in claim 28 wherein the variable annular flow-area valve is infinitely adjustable.

30. An apparatus as in claim 28 wherein the sealing surfaces are metal.

31. An apparatus as in claim 28 wherein the first member is unitary with the outer housing.

32. An apparatus as in claim 28 wherein the first tubular member is slidingly disposed in the outer housing.

33. An apparatus as in claim 28, the projection having an outer surface, and wherein the projection outer surface is arcuate.

34. An apparatus as in claim 28, the projection having an outer surface, and wherein the projection outer surface defines a flow regulating means.

35. An apparatus as in claim 28 further comprising a biasing assembly.

36. An apparatus as in claim 28 wherein the first member is designed for use downhole from the second member.

37. An apparatus as in claim 28 further comprising an actuator assembly operable to actuate the annular valve.

38. An apparatus as in claim 28 further comprising a locking assembly for selectively locking the annular valve.

39. An apparatus as in claim 28 further comprising an adjustment assembly for selectively adjusting the annular valve.

40. An apparatus as in claim 28 wherein the annular flow-area valve is movable between a partially open position allowing some fluid flow and an open position allowing for greater fluid flow.

41. A method of controlling fluid flow into a downhole tool disposed within a subterranean well, the method comprising the steps of:

placing the downhole tool having a variable annular flow-area choke in a subterranean well, the variable annular flow-area choke capable of selectively regulating fluid flow, the variable annular flow-area choke having a first generally tubular member movably and sealingly disposed within an outer housing, the first tubular member having a shoulder with a sealing surface, the first member defining an interior space therein, a second generally tubular member sealingly disposed within the outer housing, the second tubular member having a shoulder with a sealing surface, the second member movable between a sealed position wherein the sealing surfaces are in abutment and an open position wherein the sealing surfaces are spaced apart, the second member having a projection extending into the interior space of the first member when in the sealing position, the projection for controlling fluid flow through the choke when in an open position; and selectively operating the variable annular flow-area choke, thereby regulating fluid flow into the downhole tool.

42. A method as in claim 41 wherein the variable annular flow-area choke is infinitely variable.

43. A method as in claim 42 wherein the step of operating the variable annular flow-area choke further comprises moving a first generally tubular member with respect to a second generally tubular member between a closed position wherein the tubular members are in sealing end-to-end abutment and an open position.

44. A method as in 43 wherein the first tubular member is in sliding and sealing engagement with the interior of the downhole tool.

45. A method as in 42 further comprising the step of operably attaching an actuator assembly to the annular choke.

46. A method as in 42 further comprising the step of operably attaching a biasing assembly to the annular choke.

47. A method as in 42 further comprising the step of locking the annular choke in a closed position.

48. A method as in claim 41 wherein the step of operating the variable annular flow-area choke further comprises moving a first generally tubular member with respect to a second generally tubular member between a closed position wherein the tubular members are in sealing end-to-end abutment and an open position.

49. A method as in claim 48 wherein the first tubular member is in sliding and sealing engagement with the interior of the downhole tool.

50. A method as in 49 wherein the second tubular member is in sliding and sealing engagement with the interior of the downhole tool.

51. A method as in claim 41 wherein the step of operating the variable annular flow-area choke further comprises moving a first generally tubular member with respect to a second generally tubular member between a partially open position allowing restricted fluid flow and an open position.

52. A method as in 41 further comprising the step of operably attaching an actuator assembly to the annular choke.

53. A method as in 41 further comprising the step of operably attaching a biasing assembly to the annular choke.

54. A method as in 41 further comprising the step of locking the annular choke in a closed position.

55. A method as in claim 41 wherein the projection comprises a flow regulating surface.

56. A method as in claim 55 wherein the flow regulating surface is arcuate.

57. A method as in claim 55 wherein the flow regulating surface includes a labyrinthian seal.

58. A method as in claim 55 wherein the flow regulating surface is stair-stepped.

59. A method as in claim 58 wherein the flow regulating surface includes a labyrinthian seal.

60. A method as in claim 55 wherein the flow regulating surface is at least partially conical.

* * * * *